United States Patent [19]

Morrison et al.

[11] 3,973,494

[45] Aug. 10, 1976

[54] HAND PRINTING STAMP

[75] Inventors: Howard J. Morrison, Deerfield; Alan Hicks, Wilmette; Wayne A. Kuna, Oak Park, all of Ill.

[73] Assignee: Marvin Glass & Associates, Chicago, Ill.

[22] Filed: Dec. 20, 1974

[21] Appl. No.: 534,845

[52] U.S. Cl. ..... 101/373

[51] Int. Cl.[2] ..... B41K 1/08

[58] Field of Search ..... 101/372, 373, 397, 399, 101/333, 368; 46/126, 136, 133, 137

[56] References Cited

UNITED STATES PATENTS

| | | | |
|---|---|---|---|
| 745,244 | 11/1903 | Schulz | 101/373 |
| 866,723 | 9/1907 | Hill | 101/373 |
| 1,537,509 | 5/1925 | Tupper | 46/133 |
| 1,572,124 | 2/1926 | Baldridge et al. | 46/137 |
| 1,762,027 | 6/1930 | Pickup | 101/373 |
| 2,444,169 | 6/1948 | Paige | 46/126 |
| 2,530,610 | 11/1950 | Genone | 46/136 |
| 2,811,807 | 11/1957 | Swann | 46/126 X |
| 3,625,149 | 12/1971 | Allen | 101/373 |
| 3,742,644 | 3/1971 | Williams | 46/126 |

*Primary Examiner*—J. Reed Fisher
*Attorney, Agent, or Firm*—Coffee & Sweeney

[57] ABSTRACT

A hand printing stamp for transferring ink from an ink pad to a sheet of paper or the like, including movable portions on the printing face of the stamp so that different images may be reproduced from one stamp. In the embodiment disclosed, the movable parts include arms, legs and the head of a figure so that the figure may be reproduced in a plurality of articulated positions.

1 Claim, 6 Drawing Figures

Fig 1
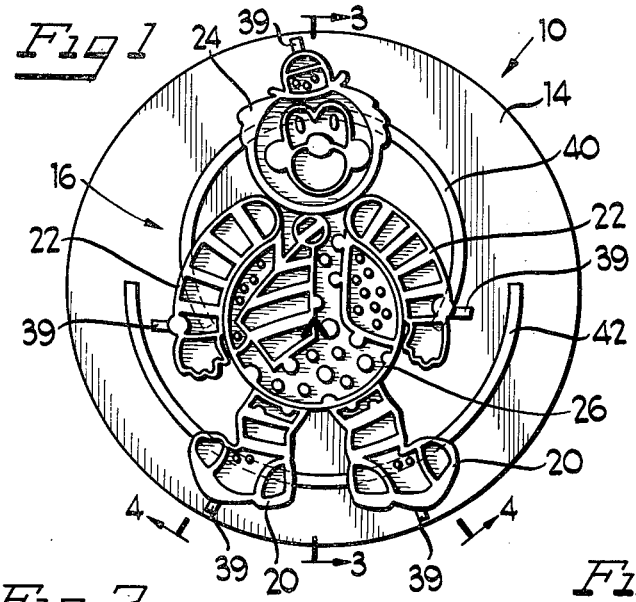
Fig 3
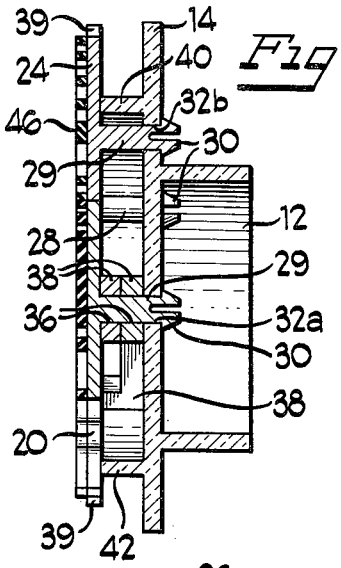
Fig 2
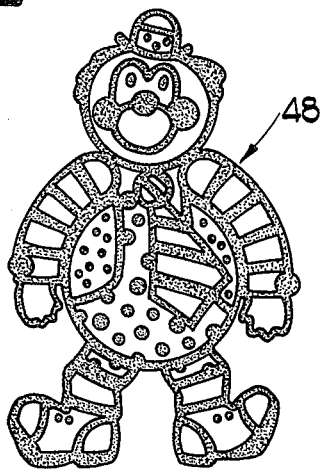
Fig 4
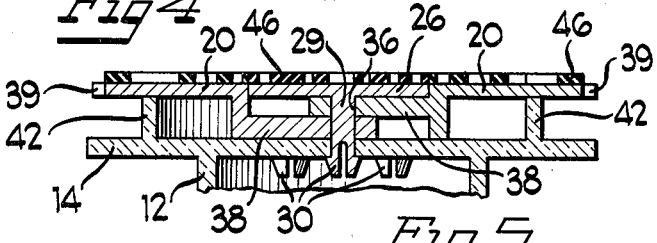
Fig 5
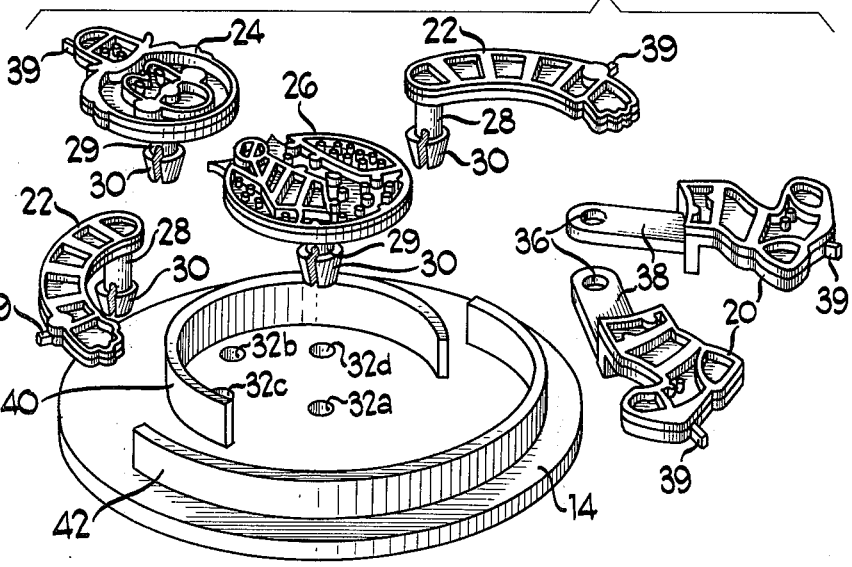
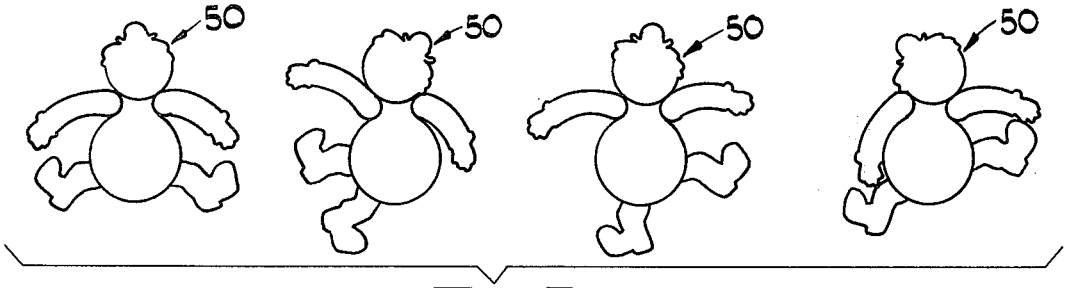
Fig 6

HAND PRINTING STAMP

BACKGROUND AND SUMMARY OF THE INVENTION

The invention pertains generally to rubber-type hand printing stamps and in particular to a stamp which has interchangeable or movable portions.

In the past stamps have been produced which permit the changing of certain information or images on the face of the stamp. The most common stamp of this type generally includes a non-movable portion such as a "Paid" or "Received" portion and a movable or changeable portion which normally includes a rotatable band having information thereon such as dates or the like. In most of these prior devices, however, the movable or changeable information was on a totally separate stamp portion, such as the rotatable band, which was introduced through an opening in the stationary portion. The information or images which were not "stamped" at a particular time were stored or held in a compartment or the like in a different plane than that of the stationary portions.

An object of the present invention is to provide a novel rubber-type hand printing stamp wherein several parts of the printing face of the stamp are movable relative to one another, to thereby provide a stamp capable of reproducing a plurality of different images.

The present invention contemplates a stamp comprising a base having a handle on one side thereof and a plurality of image portions relatively movably mounted on the side of the base opposite that of the handle whereby a plurality of different images may be reproduced with the one stamp by changing the relative positioning of the image portions. In the illustrated embodiment a figure is formed by a body image portion and relatively movable arms, legs and head image portions to provide for printing the image in different articulated positions.

Other objects, features and advantages of the invention will be apparent from the following detailed description taken in connection with the accompanying drawings.

BRIEF DESCRIPTION OF THE DRAWINGS

FIG. 1 is a plan view of the bottom or printing face of the hand printing stamp of the present invention;

FIG. 2 is a printed or stamped image made by the stamp of FIG. 1;

FIG. 3 is a vertical section taken generally along the line 3—3 of FIG. 1;

FIG. 4 is a vertical section taken generally along the line 4—4 of FIG. 1;

FIG. 5 is an exploded perspective view showing the components of the present invention; and FIG. 6 shows, in silhouette, a plurality of different images reproduced by the stamp of FIG. 1.

DESCRIPTION OF THE PREFERRED EMBODIMENT

The stamp of the present invention, generally designated 10, is shown in FIGS. 1 and 3–5. The stamp has a cylindrical handle 12 secured to a base portion 14. The base 14 movably mounts a plurality of relatively movable image printing means, generally designated 16. In the illustrated embodiment, the stamp has image means which represent a figure of a clown. The image means includes a pair of leg portions 20, a pair of arm portions 22, a face or head portion 24 and a body or torso portion 26 (see FIGS. 1 and 5).

The arm portions 22 are pivotally mounted to the base 14 by means of studs 28. The head portion 24 and the torso portion 26 also are mounted to the base by similar studs 29. All of the studs 28 and 29 have a flexible head portion 30 which collapses to pass through one of a plurality of holes **32*a*–32*d* in the base 14. The stud 29 for the torso portion 26 is received in hole 32*a*. The stud 29 for the head portion 24 is received in a hole 32*b*. The left and right arm portions (as viewed in FIGS. 1 and 5) are received in holes 32*c* and 32*d*, respectively. The stud 29 on the torso portion 26 also pivotally secures the leg portions 20 by passing through a hole 36 in an extended offset tab 38 on each leg portion. The tabs 38, being offset, as seen in FIG. 5, permit rotation of the legs 20 relative to the torso portion 26. Each of the arm portions 22, leg portions 20 and head portion 24 have tabs 39 to aid in manual rotation thereof without touching the inked surfaces. The tabs 39** are offset so as not to engage the ink pad.

Two arcuate ribs 40 and 42 are provided on the base 14 to give backing support to the aforesaid various parts of the image means 16 when an image is being produced since the various parts are raised from the base 14 to accommodate the single pivot for the leg portions 20 on the stud 29 of the torso portion 26. All of the portions of the image means include a thin layer resilient material 46 (FIGS. 3 and 4) on the face thereof for engagement with an ink pad and the paper or other material upon which the image is to be imprinted. The resilient material 46 can accommodate for any irregularities in the printing surface of the image means 16.

Thus, with the present invention, it is possible to reproduce the image of a clown 48 as shown in FIG. 2 and it is possible to vary or change the image to different articulated positions as shown by a representative set of silhouette figures 50 shown in FIG. 6.

The foregoing detailed description has been given for clearness of understanding only and no unnecessary limitations should be understood therefrom as some modifications will be obvious to those skilled in the art.

We claim:

1. A hand printing stamp, comprising:

a base having a handle on one side thereof and image forming means movably mounted on the opposite side thereof for hand stamping onto an appropriate surface, said image forming means comprising a plurality of coplanar relatively movable stamping portions in the form of a figure including a central torso portion mounted on said base and spaced therefrom, a head portion rotatably mounted on the base by pivot means spaced from said torso portion and maintaining the head portion coplanar with the torso portion, a pair of arm portions rotatably mounted on the base by pivot means located adjacent said torso portion so as to be rotatable relative thereto in arcs emanating therefrom with the arm portions coplanar with the torso portion, a pair of leg portions rotatably mounted on the base by pivot means located generally centrally of and behind said torso portion so that the entire leg portions are pivotable bodily relative to the torso portion in peripheral arcs so as to provide for multiple images of articulated positions of the figure, said leg portions each including an image forming portion spaced from said base but coplanar with said torso portion and an offset extension portion protruding beneath said torso portion to the pivot means for the leg portions, backing support ribs on said base and protruding outwardly from the base in the path of movement of the image portions for engagement with and maintaining the image forming portions of said leg portions coplanar with that of the torso portion, and said pivot means for said leg portions being provided by a common pivot pin connected to said torso portion and extending between the torso portion and said base.

* * * * *